US007260526B2

(12) United States Patent
Sall et al.

(10) Patent No.: US 7,260,526 B2
(45) Date of Patent: Aug. 21, 2007

(54) METHOD OF FILTERING NOISE OF SOURCE DIGITAL DATA

(75) Inventors: Mikhael A. Sall, St. Petersburg (RU); Sergei N. Gramnitskiy, St. Petersburg (RU); Alexandr L. Maiboroda, St. Petersburg (RU); Victor V. Redkov, St. Petersburg (RU); Anatoli I. Tikhotsky, St. Petersburg (RU); Andrei B. Viktorov, St. Petersburg (RU)

(73) Assignee: LG Electronics Inc., Seoul (KR)

( * ) Notice: Subject to any disclaimer, the term of this patent is extended or adjusted under 35 U.S.C. 154(b) by 902 days.

(21) Appl. No.: 10/370,064

(22) Filed: Feb. 21, 2003

(65) Prior Publication Data

US 2003/0171918 A1 Sep. 11, 2003

(30) Foreign Application Priority Data

Feb. 21, 2002 (KR) ..... 10-2002-0009207

(51) Int. Cl.
*G10L 21/02* (2006.01)

(52) U.S. Cl. ..... 704/226

(58) Field of Classification Search ..... None

See application file for complete search history.

(56) References Cited

U.S. PATENT DOCUMENTS 6,058,360 A * 5/2000 Bergstrom ..... 704/219
6,760,451 B1 * 7/2004 Craven et al. ..... 381/98
7,046,812 B1 * 5/2006 Kochanski et al. ..... 381/92

* cited by examiner

*Primary Examiner*—Abul K. Azad
(74) *Attorney, Agent, or Firm*—Ked & Associates, LLP

(57) ABSTRACT

A method of filtering digital audio data with short delay according to the present invention comprises the steps of: (a) buffering input source digital audio data; (b) calculating digital data that are being filtered from the buffered input source digital audio data; and (c) outputting a portion of the filtered digital data. The source digital audio data are sequence of digital samples. Buffer contents are shifted to arrange some of input samples in a buffer in the step (a). The step (b) comprises the steps of: (b-1) calculating a correlation matrix; (b-2) decomposing the correlation matrix; (b-3) calculating a filter matrix; and (b-4) calculating an approximation of the filtered digital data. In the step (b-2), the correlation matrix is represented by multiplication of three matrices where a first matrix is a matrix composed by normalized eigenvectors of the correlation matrix, a second matrix is a diagonal matrix in which eigenvalues of the correlation matrix are arranged on a principal diagonal and zeros are arranged in other positions, and a third matrix is a transposed matrix of the normalized eigenvectors of the correlation matrix.

16 Claims, 1 Drawing Sheet

METHOD OF FILTERING NOISE OF SOURCE DIGITAL DATA

BACKGROUND OF THE INVENTION

1. Field of the Invention

The present invention generally relates to a method of filtering noise of a source digital data which consists of signal and noise, and more particularly, to a method of filtering a source digital audio data with short delay, which can be applied to a signal with a correlation characteristic such as audio stream to be broadcasted or recorded using a predetermined media.

2. Description of the Related Art

Generally, noise reduction is a kind of issues proposed in various applications. Many solutions to reduce noise have been suggested and applied. Unfortunately, there is no excellent solution since the noise reduction efficiency depends on signal source, noise characteristics and environment and the noise reduction requires complex calculation and process delay. The object of noise reduction for audio signal is to lower noise level without any distortion of signal.

Main applications of noise reduction for audio signals are local and long-distance telecommunication, answering machine and wireless telephone, hands-free speakerphone, mobile telephone, airplane audio communication machine, voice recognition unit, etc.

The most popular and effective methods of reducing noise are spectral subtraction, various approaches related to optimal filtering such as Wiener filtering, Ephraim and Malah weighting law and approaches based on psychoacoustic model. The documents in which these methods are disclosed in detail are as follows: A. Akbari Azirani, R. Le Bouquin Jeannes and G. Faucon, "Speech enhancement using a Wiener filtering under signal presence uncertainty", proceedings Europe signal processing conference, Trieste, Italy, September, 1996; S. F. Boll, "Suppression of acoustic noise in speech using spectral subtraction", IEEE transaction on acoustics, speech and signal processing, vol. 27, no. 2, April, 1979; Y. Ephraim and D. Malah, "Speech enhancement using minimum mean-square error short-time spectral amplitude estimator", IEEE transaction on acoustics, speech and signal processing, vol. 32, no. 6, December, 1994; Y. Ephraim and D. Malah, "Speech enhancement using minimum mean-square error log-spectral amplitude estimator", IEEE transaction on acoustics, speech and signal processing, vol. 33, no. 2, April, 1985; S. Gustafsson, P. Jax and P. Vary, "A novel psychoacoustically motivated audio enhancement algorithm preserving background noise characteristics", proceedings international conference on acoustics, speech and signal processing,. Seattle, USA, May, 1998; S. Gustafsson, P. Jax and P. Vary, "A new approach to noise reduction based on auditory masking effects", ITG-Fachbericht 152: Sprachkommunication, Dresden, Germany, August/September, 1998; ISO/IEC, "International standard 11172-3:1993, information technology-coding of moving pictures and associated audio for digital storage media at up to about 1.5 mbit/s-part 3, audio", 1993; P. Vary, "Noise suppression by spectral magnitude estimation-mechanism and theoretical limits", vol. 8, no. 4, 1985; S. V. Vaseghi, "Advanced signal processing and digital noise reduction", John Wiley and Teubner, 1996; N. Virag, "Speech enhancement based on masking properties of the auditory system", proceedings international conference on acoustics, speech and signal processing, Detroit, USA, May, 1995; and E. Zwicker and H. Fastl, "Psychoacoustics; Facts and Models", Springer-Verlag, New York, 1990.

The various above-mentioned approaches have their own advantages and problems but the most popular and effective noise-concealment algorithm is block oriented and requires essential delay (20 ms or longer). So, these algorithms are not suitable for some applications with short delay, for example, an application based on ITU G.726 standard (1990, ITU recommendation G.726 adaptive differential pulse code modulation (ADPCM) of 40, 32, 24 and 16 Kbps).

These G.726 standard application examples are video conference system, multimedia, flight record, ISDN and satellite communication network, wireless digital telephone communication, radio/wireless local loop, pair-gain, etc.

SUMMARY OF THE INVENTION

Accordingly, the present invention is directed to a method of filtering digital audio data with short delay, which substantially obviates one or more problems due to limitations and disadvantages of the related art.

An object of the present invention is to provide a method of filtering noise of a source digital data in which noise reduction is very effective with a minimal delay time.

Additional advantages, objects, and features of the invention will be set forth in part in the description which follows and in part will become apparent to those having ordinary skill in the art upon examination of the following or may be learned from practice of the invention. The objectives and other advantages of the invention can be realized and attained by the structure particularly pointed out in the written description and claims hereof as well as the appended drawings.

To achieve these objects and other advantages and in accordance with the purpose of the invention, as embodied and broadly described herein, a method of filtering digital audio data with short delay includes the steps of: (a) buffering input source digital audio data; (b) calculating digital data that are filtered from the buffered input source digital audio data; and (c) outputting a portion of the filtered digital data.

The source digital audio data are sequence of digital samples.

Buffer contents are shifted and some of input samples are placed in a buffer in the step (a).

The step (b) includes the steps of: (b-1) calculating a correlation matrix; (b-2) decomposing the correlation matrix; (b-3) calculating a filter matrix; and (b-4) calculating an approximation of the filtered digital data.

In the step (b-2), the correlation matrix is represented by multiplication of three matrices where a first matrix of the three matrices is a matrix composed by normalized eigen vectors of the correlation matrix, a second matrix of the three matrices is a diagonal matrix in which eigen values of the correlation matrix are arranged on a principal diagonal and zeros are arranged in other positions, and a third matrix of the three matrices is a transposed matrix of the normalized eigenvectors of the correlation matrix.

The filter matrix is represented by multiplication of three matrices where a first matrix of the three matrices is a matrix composed by normalized eigenvectors of the correlation matrix, a second matrix of the three matrices is a particular diagonal matrix, and a third matrix of the three matrices is a transposed matrix of the normalized eigenvectors of the correlation matrix.

The particular diagonal matrix D is composed as follows: D=diag ($d_1$, K, $d_h$) where $$d_i = \sqrt{\frac{\lambda_{0i}}{(1+\sigma^2)\lambda_i}},$$

$\lambda_{01}$ is an estimate of an eigenvalue of a signal, and σ is an estimate of noise dispersion.

The estimate (σ) of the noise dispersion is based on a maximum selected from a minimum eigenvalue of the correlation matrix calculated for previous time interval and an estimate of noise energy as energy corresponding to the maximum selected from the minimum eigenvalue.

The step (b-4) includes the steps of: (b-4-i) multiplying the filter matrix and a matrix in which character sequence is composed by several order elements of buffered data, a first element of the character sequence being a first order element of the buffered data; and (b-4-ii) averaging elements of the matrix obtained as a result of the step (b-4-i) in a manner that the elements of the matrix are applied to elements which have a same index sum.

In the step (c), only some prearranged portions of the filtered digital data comprised of samples as the same number as input samples are outputted.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate an embodiment of the invention and together with the description serve to explain the principle of the invention. In the drawings.

DETAILED DESCRIPTION OF THE INVENTION

Figure 1:
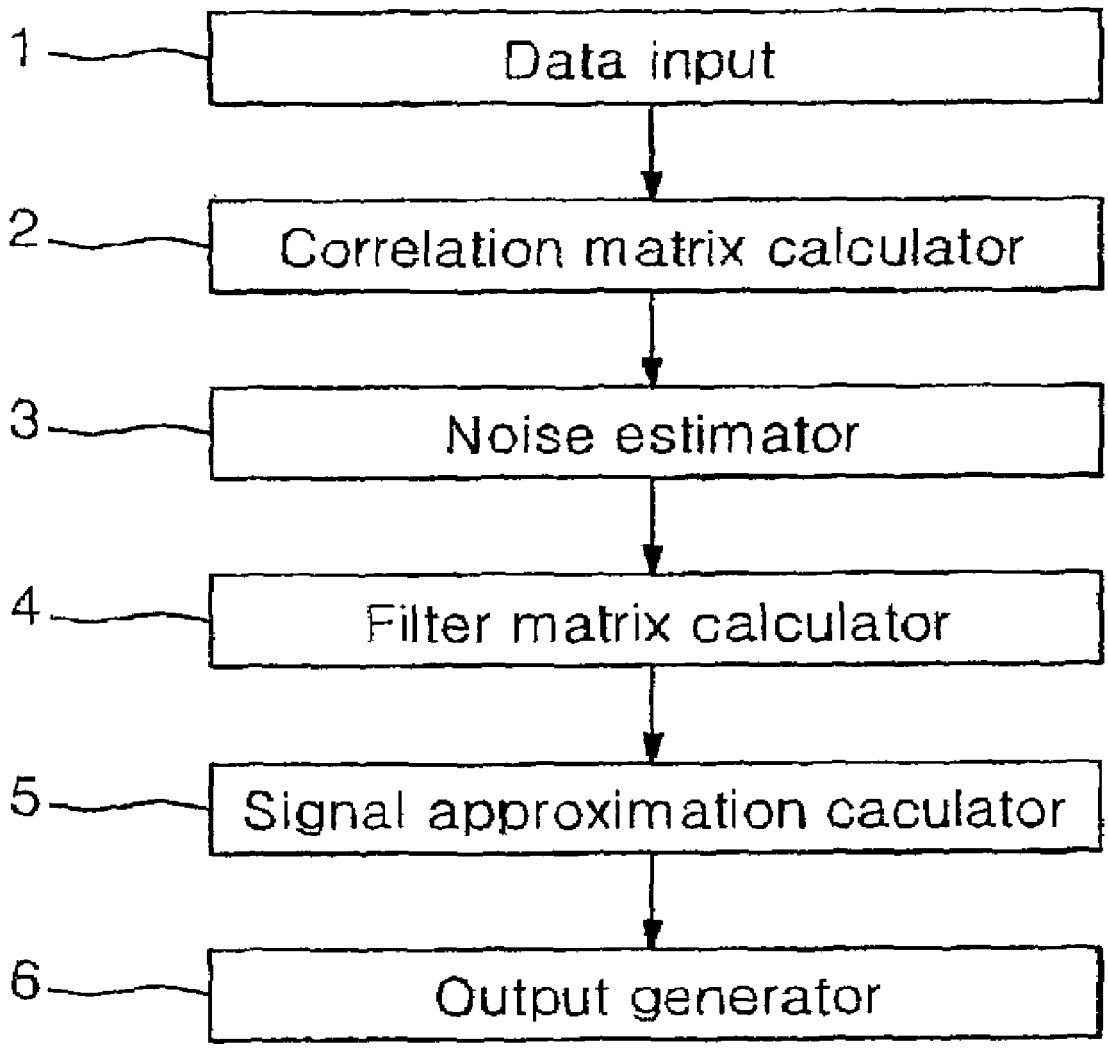
FIG. 1 illustrates a configuration for implementing the method of filtering digital audio data with short delay according to the present invention.

Reference will now be made in detail to the preferred embodiments of the present invention, examples of which are illustrated in the accompanying drawings.

Referring to FIG. 1, the first step of the method of filtering digital audio data with short delay according to the present invention relates to buffering input data stream. Here, an input data buffer is comprised of N samples, that is, $x_1$, $x_2$, K, $x_N$. A data input unit 1 shifts buffer samples of the input data in the manner that $x_i=x_{i+m}$ and i=1, K, N-m where m is a shift intermediate variable. The data input unit 1 arranges m samples from the input data stream to the input buffer (samples $x_{N-m+1}$, K, $x_N$).

Then, a correlation matrix calculator 2 calculates h×h correlation matrix C for vectors $x_1$, K and $x_N$ from the input buffer using standard formula. Here, another function of the correlation matrix calculator 2 is to decompose the correlation matrix C into the form of $C=P\Lambda P^T$ where Λ=diag ($\lambda_1$, K, $\lambda_h$), $\lambda_i$ ($\lambda_1<\lambda_2<K<\lambda_h$) is arranged eigenvalues of the correlation matrix C, P is an eigenvalue vector matrix and $P^T$ is a transposed matrix of P. This calculation can be performed using a well-known fast iteration procedure. The first (minimum) eigenvalue and energy $$\left(E = \sum_{i=1}^{N} x_i^2\right)$$

are stored in an auxiliary buffer to estimate a noise level (refer to the followings).

A noise estimator 3 scans the auxiliary buffer to find the maximum value of the first eigenvalue set. At this time, a corresponding energy $E_n$ is regarded as an estimate of the noise energy. The noise estimator 3 calculates an estimate (σ) of noise dispersion using Expression 1.

$$\sigma^2 = \frac{E_n}{E - E_n} \qquad \text{Expression 1}$$

Such an estimate (σ) of noise dispersion is based on the fact that noise components has greater rest period than signal components in an audio signal, especially speech signal. Hence, all the eigenvalues $\lambda_i$ ($\lambda_1<\lambda_2<K<\lambda_h$) gets near to the positive minimal integer. Finding the maximum eigenvalue from the first minimum value is finding the interval in which there is the minimum signal component.

A filter matrix calculator 4 calculates the matrix F through a standard procedure of matrix multiplication using Expression 2.

$$F=PDP^T \qquad \text{Expression 2}$$

where D=diag ($d_1$, K, $d_h$), $$d_i = \sqrt{\frac{\lambda_{0i}}{(1+\sigma^2)\lambda_i}},$$

$\lambda_{0i}$ is an estimate of an eigenvalue of a signal, and σ is an estimate of noise dispersion. $\lambda_{0i}$ can be calculated by the formula:

$$\lambda_{0i}=(1+\sigma^2)\lambda_i-\sigma^2.$$

A signal approximation calculator 5 calculates $\hat{X}=FX$ where $$X = \begin{pmatrix} x_1 & \Lambda & \Lambda & x_{N-h+1} \\ x_2 & & & x_{N-h+2} \\ M & & & M \\ x_h & \Lambda & \Lambda & x_N \end{pmatrix}$$

and $\hat{X}=(\hat{x}_{ij})$ where $1\leqq i\leqq h$, $1\leqq j\leqq N-h+1$.

Sequence $\bar{x}_1$, $\bar{x}_2$, K, $\bar{x}_N$ of signal approximates obtained using averaging procedure are as follows:

$$\bar{x}_1=\hat{x}_{11},$$

$$\bar{x}_2 = \frac{1}{2}(\hat{x}_{12}+\hat{x}_{21}),\ \bar{x}_3 = \frac{1}{3}(\hat{x}_{13}+\hat{x}_{22}+\hat{x}_{31}),$$

$$K,\ \bar{x}_N=\hat{x}_{h,N-h+1}.$$

An output generator 6 outputs m samples $\bar{x}_{N-m-k+1}$, K, $\bar{x}_{N-k}$ where k is a distance of prearranged tail. Such a tail is used to make the averaging procedure more effective possibly. Accordingly, delay related to filtering procedure corresponds to k+m samples. This number can be selected based on technical conditions and can be fraction.

The significant intermediate variable on which complexity of calculation depends is h but it is enough to set the intermediate variable h in the range from 4 to 8.

The method of filtering digital audio data with short delay according to the present invention can be used with no relation of G.726 data compression recommendation but when combined with G.726 recommendation, the quality of audio signal transfer of the conventional device can be improved.

The basic idea of, the present invention is to use a special filter in which intermediate variables depend on signals. This filter is composed using a noise level estimate and a correlation matrix. It is regarded that the noise level is changed weakly compared with signal variation. This assumption is applied to audio signal, especially speech signal because the noise level can be estimated using eigenvalues of a correlation matrix. This estimating procedure does not require any additional calculation procedure because it is required to calculate eigenvalues in composing the filter.

The method of filtering digital audio data with short delay according to the present invention includes the procedure to decompose the correlation matrix into three matrices. The three matrices are a matrix of eigenvalues, a diagonal matrix of eigenvalues and a transposed matrix that is a matrix of eigenvectors. Here, filtered matrices have the same structure but the diagonal matrix of eigenvalues is replaced by a particular diagonal matrix, which depends on the eigenvalues and the estimates of the eigenvalues without any noise signal.

As described above, the method of filtering digital audio data with short delay according to the present invention can be applied to the signals that have correlation characteristic such as audio streams broadcasted or recorded using a predetermined media effectively and is very effective to non-correlative white noises.

In the method of filtering digital audio data with short delay according to the present invention, modules include comparatively simple integral circuits and can provide suitable filtration to any kinds of applications either hardware or software.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method of filtering digital audio data with short delay, the method comprising the steps of:

(a) buffering input source digital audio data;

(b) calculating digital data that are filtered from the buffered input source digital audio data, wherein the calculating of digital data is performed by calculating a correlation matrix, decomposing the correlation matrix calculating a filter matrix and calculating an approximation of the filtered digital audio data; and (c) outputting a portion of the filtered audio digital data.

2. The method according to claim 1, wherein the source digital audio data are sequence of digital samples.

3. The method according to claim 1, wherein in the step (a), buffer contents are shifted and some of input samples are placed in a buffer.

4. The method according to claim 1, wherein in decomposing the correlation matrix, the correlation matrix is represented by multiplication of three matrices where a first matrix of the three matrices is a matrix composed by normalized eigen vectors of the correlation matrix; a second matrix of the three matrices is a diagonal matrix in which eigenvalues of the correlation matrix are arranged on a principal diagonal and zeros are arranged in other positions, and a third matrix of the three matrices is a transposed matrix of the normalized eigenvectors of the correlation matrix.

5. The method according to claim 1, wherein the filter matrix is represented by multiplication of three matrices where a first matrix of the three matrices is a matrix composed by normalized eigenvectors of the correlation matrix, a second matrix of the three matrices is a particular diagonal matrix, and a third matrix of the three matrices is a transposed matrix of the normalized eigenvectors of the correlation matrix.

6. The method according to claim 5, wherein the particular diagonal matrix D is composed as follows:

$$D=\mathrm{diag}\ (d_1, K, d_h)$$

where $$d_i = \sqrt{\frac{\lambda_{0i}}{(1+\sigma^2)\lambda_i}},$$

$\lambda_{0i}$ is an estimate of a signal, and $\sigma$ is an estimate of noise dispersion.

7. The method according to claim 6, wherein the estimate ($\sigma$) of the noise dispersion is based on a maximum selected from a minimum eigenvalue of the correlation matrix calculated for previous time interval and an estimate of noise energy as energy corresponding to the maximum selected from the minimum eigenvalue.

8. The method according to claim 1, wherein calculating the approximation of the filtered digital audio data comprises the steps of:

(b-4-i) multiplying the filter matrix and a matrix in which character sequence is composed by several order elements of buffered data, a first element of the character sequence being a first order element of the buffered data; and (b-4-ii) averaging elements of the matrix obtained as a result of the step (b-4-i) in a manner that the elements of the matrix are applied to elements that have a same index sum.

9. The method according to claim 1, wherein in outputting the portion of the filtered digital audio data, only some prearranged portions of the filtered digital audio data comprised of samples as the same number as input samples are outputted.

10. A method of filtering digital audio data with short delay comprising:

buffering input digital audio data;

calculating a correlation matrix based on the buffered input digital audio data;

decomposing the correlation matrix based on the calculated correlation matrix;

calculating a filter matrix based on the decomposed correlation matrix;

calculating an approximation of filtered digital data; and outputting a portion of the filtered digital data based on the calculated filter matrix.

11. The method according to claim 10, wherein the input digital audio data comprises a sequence of digital samples.

12. The method according to claim 10, wherein the buffering includes shifting buffer contents and placing input samples in a buffer.

13. The method according to claim 10, wherein the correlation matrix is represented by a calculation of three matrices, where a first matrix of the three matrices is composed by normalized eigen vectors of the correlation matrix, a second matrix of the three matrices is a diagonal matrix in which eigenvalues of the correlation matrix are arranged on a principal diagonal and zeros are arranged in other positions, and a third matrix of the three matrices is a transposed matrix of the normalized eigenvectors of the correlation matrix.

14. The method according to claim 10, wherein the filter matrix is represented by a calculation of three matrices, where a first matrix of the three matrices is a matrix composed by normalized eigenvectors of the correlation matrix, a second matrix of the three matrices is a particular diagonal matrix, and a third matrix of the three matrices is a transposed matrix of the normalized eigenvectors of the correlation matrix.

15. The method according to claim 10, wherein calculating the approximation of the filtered digital data comprises:

multiplying the filter matrix and a matrix in which character sequence is composed by order elements of buffered data, a first element of the character sequence being a first order element of the buffered data; and averaging elements of the matrix obtained as a result of the multiplying in a manner that the elements of the matrix are applied to elements that have a same index sum.

16. The method according to claim 10, wherein outputting the portion of the filtered digital data includes outputting only some portions of the filtered digital data comprised of samples as the same number as input samples.

* * * * *